US005842322A

United States Patent [19]

Heudecker

[11] Patent Number: 5,842,322

[45] Date of Patent: Dec. 1, 1998

[54] CLOSURE MEMBER FOR CROWN CORK APPLICATOR

[75] Inventor: Gerhard Heudecker, Pentling, Germany

[73] Assignee: Krones Aktiengesellschaft Hermann Kronseder Maschinenfabrik, Neutraubling, Germany

[21] Appl. No.: 765,582

[22] PCT Filed: May 2, 1996

[86] PCT No.: PCT/EP96/01815

§ 371 Date: May 5, 1997

§ 102(e) Date: May 5, 1997

[87] PCT Pub. No.: WO96/34822

PCT Pub. Date: Nov. 7, 1996

[30] Foreign Application Priority Data

May 3, 1995 [DE] Germany ..... 295 07 335 U

[51] Int. Cl.[6] ..... B65D 45/00

[52] U.S. Cl. ..... 53/319; 53/359; 53/309

[58] Field of Search ..... 53/264, 319, 359, 53/488, 306, 309, 310, 368

[56] References Cited

U.S. PATENT DOCUMENTS

| | | | |
|---|---|---|---|
| 1,299,551 | 4/1919 | Calleson | 53/368 |
| 2,366,524 | 1/1945 | Harder | 53/310 |
| 4,527,377 | 7/1985 | Hayashe et al. | 53/167 |
| 4,602,473 | 7/1986 | Hayashi et al. | 53/510 |
| 4,655,029 | 4/1987 | Weiss | 53/510 |
| 4,729,204 | 3/1988 | Weiss | 53/510 |
| 5,040,354 | 8/1991 | Ahlers et al. | 53/167 |
| 5,150,558 | 9/1992 | Bernhard | 53/167 |

FOREIGN PATENT DOCUMENTS

| | | | |
|---|---|---|---|
| 0 470 360 | 1/1994 | European Pat. Off. | B67B 3/12 |
| 0 645 339 | 3/1995 | European Pat. Off. | B67B 3/00 |
| 83 08 616.1 | 3/1983 | Germany | B67B 3/10 |

*Primary Examiner*—Daniel B. Moon
*Assistant Examiner*—John Paradiso
*Attorney, Agent, or Firm*—Tilton, Fallon, Lungmus & Chestnut

[57] ABSTRACT

A closure member for crown cork applicators, which comprises a closure cone and an ejector engaging the longitudinal bore of said closure cone, is provided with an observation opening connecting the bore to the outside thereof, said observation opening having an aperture angle of at least 180° and being dimensioned such that the ejector is located completely within said observation opening. The large observation opening defined in this way permits the best possible access to the particularly critical areas of the closure member for the purpose of examination, cleaning, disinfection or the like.

11 Claims, 1 Drawing Sheet

CLOSURE MEMBER FOR CROWN CORK APPLICATOR

The present invention refers to a closure member for crown cork applicators. A closure member of this type is already known in the case of which four observation openings are provided on the same level and are uniformly distributed over the circumference with four connecting bridges extending between them (German-Utility Model 83 08 616.1). By means of the four observation openings having the same size and an aperture angle of less than 90°, the longitudinal bore and the ejector provided therein can be examined to a certain extent and, if necessary, the "internal area" of the closure member bordering on the mouth of the respective vessel can be cleaned manually or mechanically or disinfected. An infection or contamination of the vessel or of the content thereof in the course of the closing operation can be prevented in this way.

It is the object of the present invention to substantially improve with the aid of simple means the examination as well as the cleaning and disinfection possibilities in the case of a closure member according to the generic clause.

According to the present invention, this object is achieved by the feature that an observation opening has an aperture angle of at least 180°.

The large observation opening defined in accordance with the present invention permits the best possible access to the particularly critical areas of the closure member. This optimum access is especially given, if, according to a further development of the present invention, the aperture angle of the observation opening is dimensioned such that the ejector is located completely within said observation opening.

Other advantageous further developments, which all contribute to a good accessibility and a simple, stable structural design of the closure member, are disclosed. Special emphasis is placed on the further development disclosed according to which only a single observation opening and a single bridge piece are provided. It turned out that, in spite of its "off-center" position relative to the closure cone, this bridge piece is easily able to transmit the forces in the order of 200 kgf occurring at the closure cone during the closing operation.

Figure 1:
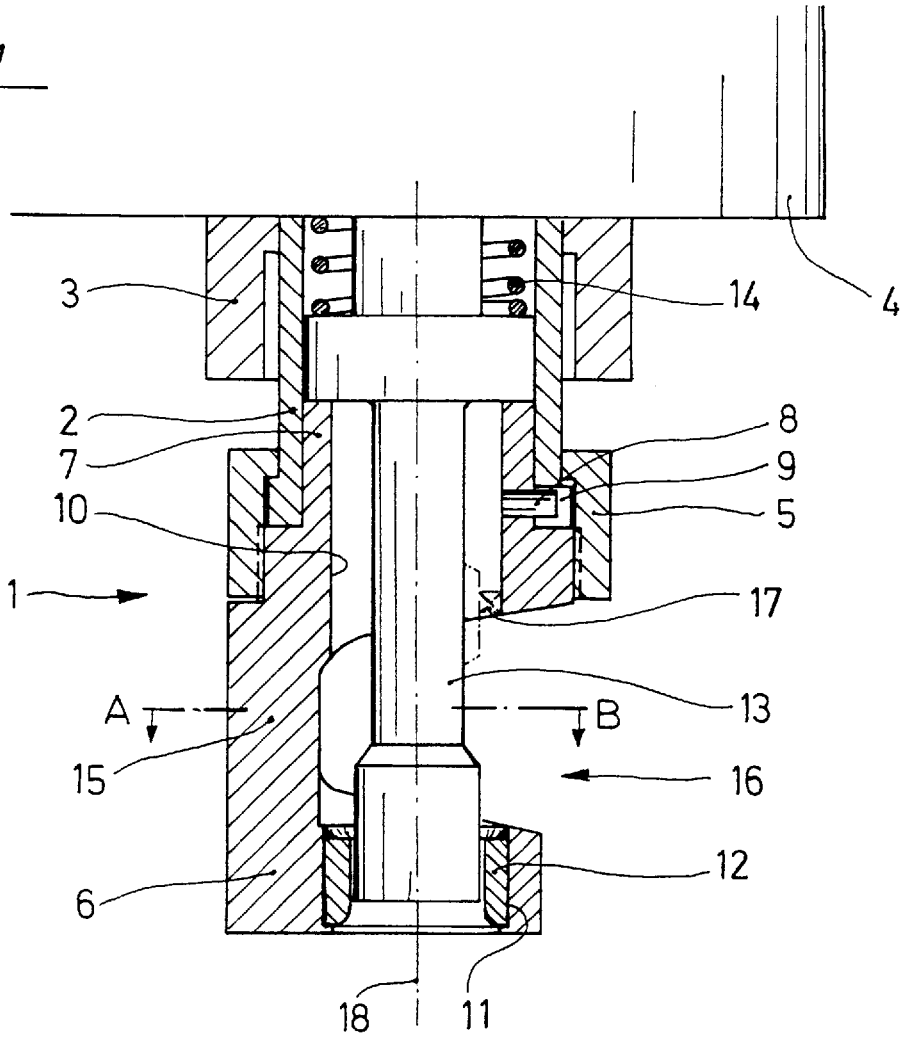
Figure 2:
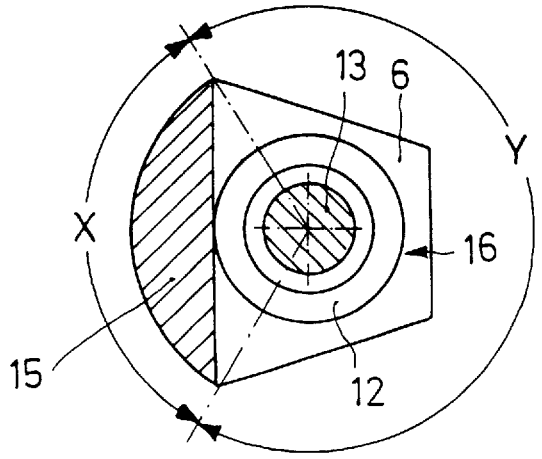

In the following, one embodiment of the present invention will be described on the basis of the drawings, in which FIG. 1 shows a vertical section through a closure member, FIG. 2 shows section A B according to FIG. 1.

The closure member 1 according to FIG. 1 and 2 includes a tubular housing 2 which is received in a vertically displaceable manner in a vertical bushing 3 of a rotatable top 4 of a crown cork applicator that is not shown in detail. At the lower end of the housing 2, which is provided with an outwardly projecting collar, a holding member 6 is releasably fastened by means of a sleeve nut 5, said holding member 6 having a U-shaped configuration when seen from the side. The holding member 6 is provided with a hollow-cylindrical projection 7 on the upper side of the horizontal upper leg; by means of said projection 7, it is centered in the bore of the housing 2. An outwardly projecting pin 8 is secured in position in said projection 7, said pin 8 engaging a recess 9, which is formed at the lower edge of the housing 2, so as to prevent any rotational movement. The upper leg, which constitutes part of the holding member 6 and which has a circular contour, is additionally provided with a vertical bore 10 extending concentrically with the central axis of the housing 2. The horizontal lower leg of the holding member 6 has also formed therein a vertical bore 11 extending concentrically with the central axis of the housing 2.

An annular closure cone 12 is secured in position in the lower bore 11 of the holding member 6, said closure cone 12 carrying out the deformation work when a crown cork is fixed to the mouth of a vessel. The upper bore 10 of the holding member 6 surrounds a rodlike ejector 13 in spaced relationship therewith, said ejector 13 being supported in the housing 2 in a vertically displaceable manner and being elastically fixed at its lower end position, which is shown in FIG. 1, by means of a compression spring 14 arranged in the housing 2. The enlarged lower end of the ejector 13 is accommodated in the longitudinal bore of the closure cone 12 with a certain amount of play and defines with said longitudinal bore an annular gap into which glass fragments, liquid residues etc. can easily penetrate.

The two spaced horizontal legs of the holding member 6, which is made from solid metal and formed as an integral component, are interconnected by a vertical bridge piece 15, which extends at the side of the ejector 13 in spaced relationship therewith. The bridge piece 15 transmits the force occurring at the closure cone 12 during the closing operation from the lower to the upper leg of the holding member 6 where it is centrally passed on into the housing 2. With regard to the central axis 18 of the closure member 1, the only bridge piece 15 covers an angle X of approx. 120°, i.e. it leaves open an observation opening 16 extending over an angle Y of approx. 240° around the ejector 13 on a level directly above the closure cone 12. The only observation opening 16 is so large that, when looking between the legs of the holding member 6 from the side, the ejector 13 is located completely within said opening 16, this being the viewing angle according to FIG. 1. This means that, on the level of the observation opening 16, the ejector 13 neither covers parts of the bridge piece 15 nor is it covered by parts of the bridge piece 15 in this direction of sight. The ejector 13 as well as the annular gap between said ejector and the closure cone 12 are, consequently, very easily accessible, either for the purpose of visual examination with regard to contamination or for the purpose of manual or mechanical cleaning or disinfection, e.g. by means of stationary spray nozzles directed towards the observation opening 16. This is additionally facilitated by the fact that the observation opening 16 is directed radially outwards relative to the axis of rotation of the top 4 and is therefore particularly easily accessible from the outer side of the crown cork applicator.

As can be seen in FIG. 1, the sides of the horizontal legs of the holding member 6 facing each other are bevelled towards the bridge piece 15 and merge with said bridge piece 15 in rounded transitions. A particularly good force characteristic is obtained in this way. The bridge piece 15 can also be a two-part component; it can, for example, consist of two parallel round rods between which a second narrow observation window is defined. As indicated by a dot-and-dash line in FIG. 1, it is also possible to fix a sealing ring 17 in the bore 10, said sealing ring sliding on an enlarged area of the ejector 13.

I claim:

1. A closure member for crown cork applicators, comprising in combination an annular closure cone, an ejector engaging a longitudinal bore of said annular closure cone and said at least one observation opening connecting said longitudinal bore to the outside, said observation opening (16) having an aperture angle (Y) of at least 180°.

2. A closure member according to claim 1, wherein said aperture angle (Y) of said observation opening (16) is dimensioned such that said ejector (13) is accessible and visible from the outside through said observation opening.

3. A closure member according to claim 1, wherein there is only one observation opening (16), said observation opening (16) is delimited by a single bridge piece (15) on the left and right sides thereof, said bridge piece (15) extending in spaced relationship with said ejector (13).

4. A closure member according to claim 1, and including a U-shaped holding member (6) having a connecting leg and two free legs, each of said connecting legs having a bore therein extending coaxially with said longitudinal bore of said closure cone, said annular closure cone (12) being provided in said bore of one of said free legs of said holding member (6) and the ejector (13) being located within the bore of the other said free leg of said holding member (6), said observation opening (16) being defined between said two free legs.

5. A closure member according to claim 4, wherein said connecting leg of said U-shaped holding member (6) forms said bridge piece (15) delimiting said observation opening (16) on the side.

6. A closure member according to claim 5, wherein said two free legs of the holding member (6) are bevelled towards said bridge piece (15) and merge with said bridge piece (15).

7. A closure member according to claim 4, wherein said U-shaped holding member (6) is releasably fixed to a tubular housing (2).

8. A closure member according to claim 7, wherein a hollow-cylindrical projection (7) is formed on the outer side of said free leg of said holding member (6) including said bore (10) for said ejector (13), said holding member (6) being centered in said tubular housing (2) by means of said hollow-cylindrical projection (7).

9. A closure member according to claim 4, 5, 6, 7 or 8, and having a sealing ring (17) secured in position in said bore (10) for said ejector (13), said sealing ring (17) abutting on said ejector (13).

10. A closure member according to claim 1, wherein said bridge piece (15) is parallel to said ejector (13).

11. A closure member according to claim 6, wherein said two free legs merge with said bridge piece (15) in rounded transitions.

* * * * *